US007503293B2

(12) United States Patent
Lettmann et al.

(10) Patent No.: US 7,503,293 B2
(45) Date of Patent: Mar. 17, 2009

(54) ADJUSTABLE CAMSHAFT

(75) Inventors: Markus Lettmann, Kieselbronn (DE); Falk Schneider, Korntal-Münchingen (DE)

(73) Assignee: MAHLE International GmbH, Stuttgart (DE)

( * ) Notice: Subject to any disclaimer, the term of this patent is extended or adjusted under 35 U.S.C. 154(b) by 42 days.

(21) Appl. No.: 11/820,257

(22) Filed: Jun. 19, 2007

(65) Prior Publication Data

US 2007/0295296 A1 Dec. 27, 2007

(30) Foreign Application Priority Data

Jun. 22, 2006 (DE) ..... 10 2006 028 611

(51) Int. Cl.
*F01L 1/34* (2006.01)

(52) U.S. Cl. ..... 123/90.15; 123/90.16; 123/90.34; 123/90.6; 29/888.1; 464/160

(58) Field of Classification Search ..... 123/90.15, 123/90.16, 90.17, 90.18, 90.27, 90.31, 90.6, 123/90.33, 90.34, 90.38; 29/888.1; 464/1, 464/2, 160

See application file for complete search history.

(56) References Cited

U.S. PATENT DOCUMENTS 6,481,401 B1 11/2002 Schäfer
7,069,892 B2 * 7/2006 Lechner et al. ..... 123/90.6

FOREIGN PATENT DOCUMENTS

| | | | |
|---|---|---|---|
| DE | 3624827 | A1 | 2/1988 |
| DE | 197 57 504 | A1 | 7/1999 |
| DE | 100 20 119 | A1 | 10/2001 |

* cited by examiner

*Primary Examiner*—Ching Chang
(74) *Attorney, Agent, or Firm*—Collard & Roe, P.C.

(57) ABSTRACT

The present invention relates to an adjustable camshaft in which an inside shaft and an outside shaft, each being fixedly connected to cams, are mounted so they are rotatable in relation to one another. To produce the relative movement, a hydraulic adjusting mechanism is provided on one of the ends thereof; in the adjusting mechanism, first and second rotatable adjusting elements are each fixedly connected to one of the two shafts opposite one another. Adjacent to the adjusting mechanism, the outside shaft is fixedly connected to a first bearing ring supporting at least the outside shaft in a stationary first abutment. Alternatively, it is essential to the present invention either that the first adjusting element is supplied with hydraulic medium via hydraulic channels running in a second abutment and a second bearing ring or a pressure bearing disk is provided with corresponding hydraulic channels between the adjusting mechanism and the first abutment, the hydraulic channels supplying hydraulic medium to the second adjusting element.

9 Claims, 2 Drawing Sheets

ADJUSTABLE CAMSHAFT

Figure 1:
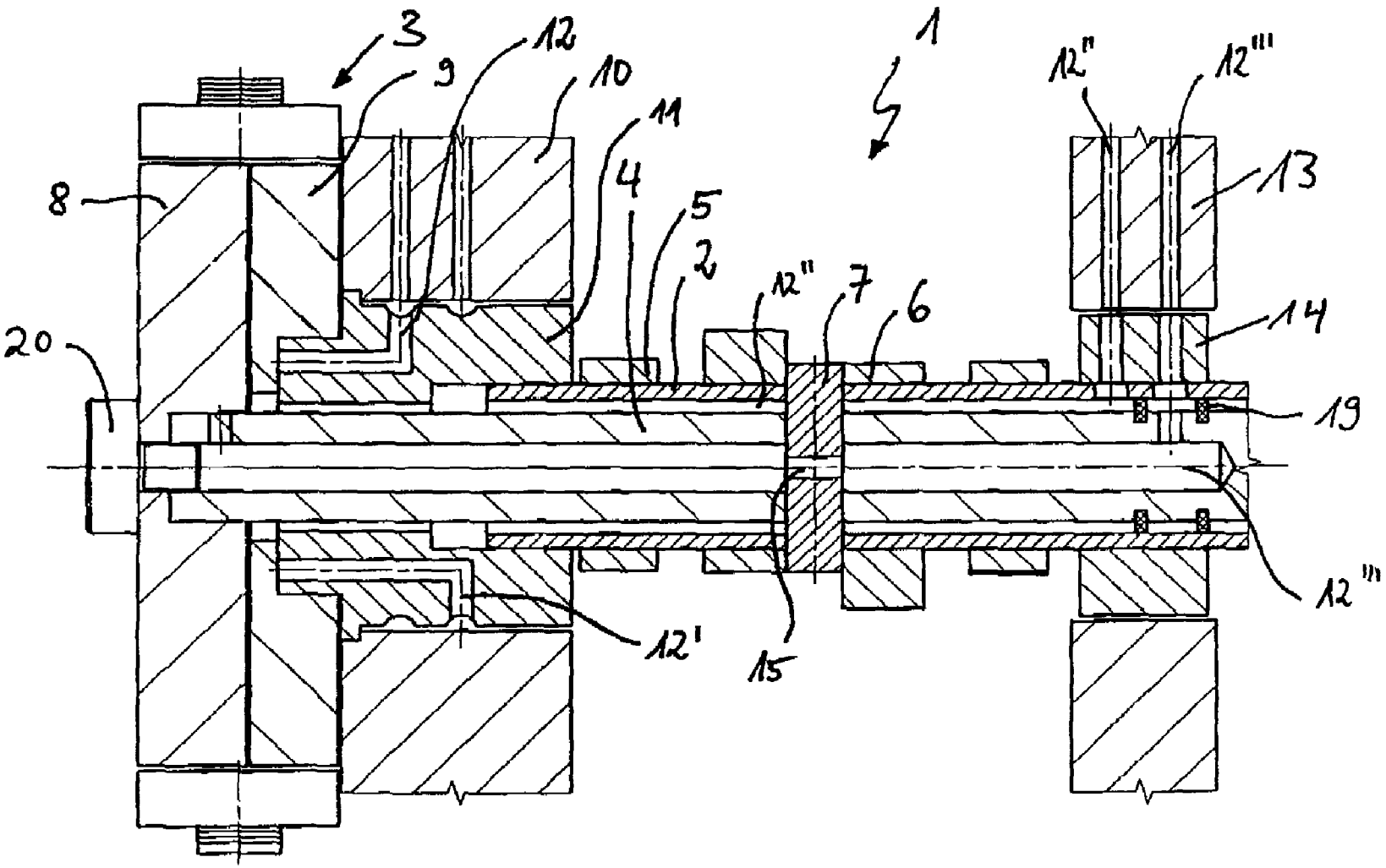

The invention relates to an adjustable camshaft, in particular for internal combustion engines of motor vehicles according to the preamble of patent claim 1. In addition, the invention also relates to an adjustable camshaft according to the preamble of patent claim 3.

In the case of camshafts having a hydraulic adjusting mechanism comprising two adjusting elements operating independently, the hydraulic lines required for the hydraulic supply for the adjusting mechanism are often accommodated in a first abutment situated in proximity to the adjusting mechanism. In the case of two hydraulic adjusting elements for independent control of exhaust and inlet cams, however, this necessitates a total of four hydraulic lines, all of which must be accommodated side-by-side in the first abutment in the axial direction of the camshaft. Since the axial width of the first abutment is limited because of boundary conditions due to the design, the arrangement of all hydraulic channels within the first abutment constitutes a problem that is not to be underestimated.

The present invention relates to the problem of providing an improved embodiment of a generic camshaft which is characterized in particular by a structurally simple arrangement of hydraulic lines that supply fluid to the hydraulic adjusting mechanism.

This problem is solved according to the present invention by the subjects of the Independent claims 1 and 3. Advantageous embodiments are the subject of the dependent claims.

The invention according to claim 1 is based on the general idea of dividing the arrangement of hydraulic channels for the hydraulic adjusting mechanism between two abutments of the camshaft. The inventive adjustable camshaft has an inside shaft and an outside shaft, each shaft being fixedly connected to cams and rotatable in relation to one another. A relative movement of the two shafts is produced by a hydraulic adjusting mechanism in which a first and a second adjusting element that are rotatable with respect to one another are each connected fixedly to one of the two shafts. Adjacent to the aforementioned hydraulic adjusting mechanism, the outside shaft is fixedly connected to a first bearing ring supported in a stationary first abutment. This first bearing ring has two hydraulic channels which connect the hydraulic channels of the second adjusting element to the hydraulic channels in the stationary first abutment. The second adjusting element of the adjusting mechanism is thus supplied with hydraulic fluid through the hydraulic channels running in the first bearing ring and/or in the stationary first abutment. Axially adjacent to the first abutment there is a stationary second abutment having a second bearing ring, which also has two hydraulic channels connecting corresponding hydraulic channels in the second abutment to hydraulic channels of the first adjusting element, so the first adjusting element is supplied with hydraulic fluid through hydraulic channels running in the second abutment and in the second bearing ring is axially adjacent to the first abutment. Due to this arrangement, the complexity in terms of installation space for a total of four hydraulic channels arranged axially side-by-side in the first abutment is eliminated and only the hydraulic channels for supplying the second adjusting element of the second adjusting mechanism are accommodated in the first stationary abutment while the hydraulic supply for the first adjusting element is provided via the hydraulic channels arranged in the second bearing ring and/or in the second abutment. In principle, this also permits a reduction in size of the first abutment and/or the first bearing ring. Since the second bearing and/or the second abutment is also present anyway on traditional cylinder heads and/or camshaft bearings, these may be utilized for the inventive accommodation of the hydraulic channels supplying the first adjusting element.

The invention is also based on the general idea that according to an alternative embodiment as recited in claim 3, four hydraulic channels are to be arranged in the first bearing ring, two of them supplying hydraulic fluid to the first adjusting element and two supplying hydraulic fluid to the second adjusting element. The channels supplying hydraulic fluid to the first adjusting element then pass through the first bearing ring essentially in the radial direction and connect the hydraulic channels running in the first abutment to hydraulic channels running in/on the inside shaft, these hydraulic channels in turn communicating with hydraulic channels of the first adjusting element. The other two hydraulic channels provided in the first bearing ring are connected at one end to communicate with the second adjusting element of the adjusting mechanism and at the other end with hydraulic channels running inside a pressure bearing disk and hydraulic channels in the first abutment. In this alternative embodiment, it is also possible to solve the problem of four hydraulic channels being arranged essentially axially side-by-side inside the first abutment in combination with the difficulty of connecting same to hydraulic channels arranged in the first bearing ring.

In the case of an advantageous embodiment of the inventive approaches, a first hydraulic channel supplying hydraulic fluid to the first adjusting element is arranged coaxially in the inside shaft in some areas while a second hydraulic channel supplying hydraulic fluid to the first adjusting element is arranged between the inside shaft and the outside shaft in at least some areas. For the two alternative embodiments, a hydraulic channel that supplies hydraulic fluid to the first adjusting element is thus arranged within the inside shaft in a manner that minimizes installation space, so the inside shaft is designed essentially as a hollow shaft, while a second hydraulic channel supplying hydraulic fluid to the first adjusting element runs between the inside shaft and the outside shaft and therefore is also designed to minimize the installation space. For both alternative embodiments thus a hydraulic channel that supplies hydraulic fluid to the first adjusting element is arranged within the inside shaft in a manner that minimizes the installation space, so that this inside shaft is designed essentially as a hollow shaft, while a second hydraulic channel supplying hydraulic fluid to the first adjusting element runs between the inside shaft and the outside shaft and is therefore also accommodated in a manner that minimizes the installation space. Thus only the hydraulic channels supplying hydraulic fluid to the second adjusting element are arranged outside of the outside shaft, i.e., in a first or a second bearing ring and/or a pressure bearing disk.

A pin expediently passes through the hydraulic channel arranged in the inside shaft and has at least one through-opening running across its longitudinal axis, guaranteeing unhindered flow of hydraulic fluid within the hydraulic channel in the inside shaft. The cams belonging to the inside shaft and the pin required for the inside shaft would at least interfere with the flow of hydraulic fluid within the hydraulic channel arranged in the inside shaft if the aforementioned through-opening were not provided. The through-opening may be designed as a simple transverse bore or may have a plurality of transverse bores, preferably intersecting one another, which eliminates the need for an accurate alignment of the pinning in such a manner that the through-opening runs essentially parallel to the hydraulic channel. As an alternative, the pin may also be constricted in the central section. The at least one through-opening provided in the pinning does not have any negative effect on a connection between the cams and the inside shaft so it is possible to transfer the adjusting movement between the inside shaft and the respective cams with no problem.

Advantageous exemplary embodiments explained below are illustrated in the drawings.

Figure 2:
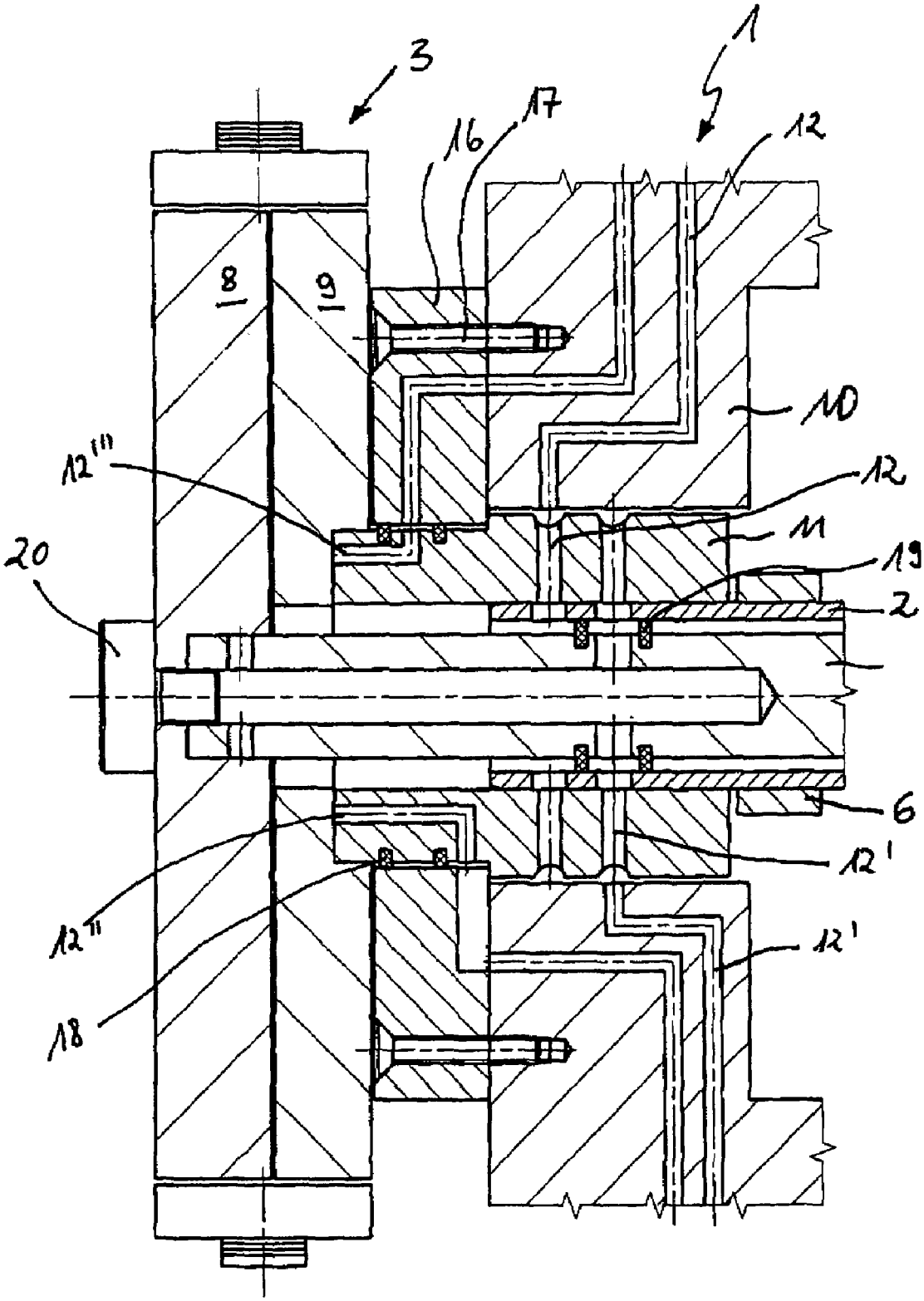

The drawings show, each in schematic diagrams,

FIG. 1 an inventive camshaft in which a first adjusting element of an adjusting mechanism is supplied with hydraulic fluid through hydraulic lines which communicate with hydraulic lines in a second abutment, FIG. 2 an alternative embodiment if the camshaft from FIG. 1 with a pressure bearing disk.

According to FIG. 1, an axial end area of an adjustable camshaft 1 has an inside shaft 4 mounted in an outside shaft 2 so that it is rotatable via a hydraulic adjusting mechanism 3 arranged at the end. The two shafts 2 and 4 each have cams 5 and 6 fixedly connected to them for valve control of an internal combustion engine. The cams 5 are fixedly connected to the outside shaft 2 while the cams 6 are connected to the inside shaft 4 in a rotationally fixed manner via pinning 7. The pins 7 run through the outside shaft 2 so that an independent rotational movement of the inside shaft 4 with the cams 6 pinned to it is possible with respect to the outside shaft 2. To create a relative rotation between the inside shaft 4 and the outside shaft 2, the hydraulic adjusting mechanism 3 is provided, as mentioned above, a first and a second rotatable adjusting element 8 and 9 that are rotatable with respect to one another, each being connected to one of the two shafts 4 and 2, are provided there. The first adjusting element 8 is fixedly connected to the inside shaft 4 while the second adjusting element 9 is fixedly connected to the outside shaft 2. In addition, the outside shaft 2 is adjacent to the adjusting mechanism 3 and is fixedly connected to a first bearing ring 11 that supports at least the outside shaft 2 in a stationary first abutment 10.

According to the first alternative of the inventive camshaft 1, the first bearing ring 11 has two hydraulic channels 12 and 12' which communicate at one end with hydraulic channels in the stationary first abutment 10 and at the other end with the second adjusting element 9 of the adjusting mechanism 3. The supply of hydraulic fluid to the second adjusting element 9 is accomplished here via hydraulic channels 12, 12' arranged in the first bearing ring 11 and in the first abutment 10. Hydraulic fluid is supplied to the first adjusting element 8 of the adjusting mechanism 3 via hydraulic channels 12" and 12''' which are provided in a second abutment 13 arranged in a stationary position adjacent to the first abutment 10 and a second bearing ring 14 mounted on the former. The two hydraulic channels 12" and 12''' supplying hydraulic fluid to the first adjusting element 8 run radially to the camshaft 1 in the second abutment 13 and in the second bearing ring 14 and also run radially through the outside shaft 2 whereby the hydraulic channel 12" runs between the inside shaft 4 and the outside shaft 2 up to the first adjusting element 8, while the hydraulic channel 12''' runs coaxially and within the inside shaft 4. The supply of hydraulic fluid to the first adjusting element 8 of the adjusting mechanism 3 is thus separated from the supply of hydraulic fluid to the second adjusting element 9 and is shifted to another abutment 13 of the camshaft and/or the respective bearing ring 14. Accordingly, this relieves the stress on the situation with regard to installation space in the area of the first abutment 10 is relieved.

According to FIG. 1, the pinning 7 connecting the cams 6 to the inside shaft 4 runs across the hydraulic channel 12''' running within the inside shaft 3 and would interrupt flow of hydraulic medium in same if the pinning did not have a through-opening 15 which is preferably aligned with the hydraulic channel 12''' and across the longitudinal axis of the pinning 7. The through-opening 15 ensures unhindered flow of hydraulic fluid within the channel 12''' and thus ensures a reliable supply of hydraulic fluid to the first adjusting element 8. It is also conceivable here for the through-opening 15 to be formed from a plurality of through-holes and/or openings running across the pins 7 so that an accurate alignment of the pins 7, which should ensure unhindered flow of hydraulic fluid through the through-opening 15, can be omitted.

In an alternative embodiment of the camshaft 1 according to FIG. 2, an adjusting mechanism 3 is again provided, having a first adjusting element 8 fixedly connected to the inside shaft 4 and a second adjusting element 9 fixedly connected to the first bearing ring 11 and the outside shaft 2. In contrast with FIG. 1, however, the bearing ring 11 in FIG. 2 has four hydraulic channels 12, 12', 12" and 12''', two hydraulic channels 12 and 12' communicating at one end with corresponding hydraulic channels in the first abutment 10 and at the other end communicating with the first adjusting element 8 via hydraulic channels 12 and 12' arranged in/on the inside shaft 4. The two other hydraulic channels 12" and 12''' communicate at one end with hydraulic channels in the first abutment 10 via hydraulic channels running in a pressure bearing disk 16 and at the other end with the second adjusting element 9. The pressure bearing disk 16 serves to adjust an axial play of the camshaft 1 and is connected fixedly to the first abutment 10 via corresponding connecting means 17, e.g., screws. In this alternative embodiment, the problem of an exclusive axially adjacent channel guidance in the first abutment 10 is thus solved.

For both embodiments, it is true that a fixation mechanism 20 which secures the adjusting mechanism 3 on the camshaft 1 and seals the hydraulic channel 12''' (see FIG. 1) or 12' (see FIG. 2) tightly on one end axially, said hydraulic channel being arranged coaxially within the inside shaft 4.

According to FIG. 2, a first radial seal 18 is provided between the first bearing ring 11 and the pressure bearing disk 16, serving to seal the hydraulic channels 12" and 12''' that supply hydraulic fluid to the second adjusting element 9. On the other hand, a second radial seal 19 is provided between the inside shaft 4 and the outside shaft 2 to seal the hydraulic channels (12''' in FIGS. 1 and 12' in FIG. 2) that supply hydraulic fluid to the first adjusting element 8.

In general, the first bearing ring 11 and/or the second bearing ring 14 may be shrunk onto the outside shaft 2 and thereby fixedly connected to it.

All the features described in the description and characterized in the following claims may be essential to the invention either individually or when combined in any form with one another.

The invention claimed is:

1. An adjustable camshaft (1), for internal combustion engines of motor vehicles, in which two shafts (2, 4), namely an inside shaft (4) and an outside shaft (2) that are each fixedly connected to cams (5, 6) are rotatable in relation to one another, the cams (6) belonging to the inside shaft (4) are each fixedly connected to the inside shaft (4) by pinning (7), to produce this relative movement, a hydraulic adjusting mechanism (3) is provided on one of the ends, a first and a second rotatable adjusting element (8, 9) each being fixedly connected to one of the two shafts (4, 2) opposite one another, the outside shaft (2) is adjacent to the adjusting mechanism (3) and is fixedly connected to a first bearing ring (11) that supports at least the outside shaft (2) in a stationary first abutment (10), comprising the features the first bearing ring (11) having two hydraulic channels (12, 12') which communicate at one end with hydraulic channels in the stationary first abutment (10) and at the other end with the second adjusting element (9), a stationary second abutment (13) is provided with a second bearing ring (14) axially at a first location or a subsequent location adjacent to the first abutment (10), said second bearing ring having two hydraulic channels (12", 12'''), each communicating at one end with hydraulic channels in the second abutment (13) and at the other end with the first adjusting element (8) via hydraulic channels running in/on the inside shaft (4).

2. The camshaft according to claim 1, wherein the pin (7) penetrates through the hydraulic channel (12''') situated in the inside shaft (4) and has a through-opening or local constriction (15) across its longitudinal axis, ensuring unhindered flow of hydraulic fluid within the hydraulic channel (12''').

3. The camshaft according to the preamble of claim 1, comprising the features the first bearing ring (11) has four hydraulic channels (12, 12', 12", 12''') of which two hydraulic channels (12, 12') communicate at one end with hydraulic channels in the first abutment (10) and at the other end with the first adjusting element (8) via hydraulic channels arranged in/on the inside shaft (4) and two hydraulic channels (12", 12''') communicate at one end with hydraulic channels in the first abutment (10) via hydraulic channels running in a pressure bearing disk (16) provided between the adjusting mechanism (3) and the first abutment (10) and communicate at the other end with the second adjusting element (9).

4. The camshaft according to claim 3, wherein the pressure bearing disk (16) is designed for adjusting an axial play of the camshaft (1).

5. The camshaft according to claim 3, wherein a first radial seal (18) is provided between the first bearing ring (11) and the pressure bearing disk (16) for sealing the hydraulic channels (12", 12''') supplying hydraulic fluid to the second adjusting element (9), a second radial seal (19) is provided between the inside shaft (4) and the outside shaft (2) to seal the hydraulic channels (12', 12) supplying hydraulic fluid to the first adjusting element (8).

6. The camshaft according to claim 1, wherein a first hydraulic channel supplying hydraulic fluid to the first adjusting element (8) is arranged coaxially in the inside shaft (4) in some areas, while a second hydraulic channel supplying hydraulic fluid to the first adjusting element (8) is arranged between the inside shaft (4) and the outside shaft (2) in at least some areas.

7. The camshaft according to claim 1, wherein the hydraulic channels (12, 12') running in the first bearing (11) are oriented in the axial direction toward the second adjusting element (9) and in the radial direction to the first abutment (10).

8. The camshaft according to claim 1, wherein a fixation device (20) is provided on the side of the adjusting mechanism (3) facing away from the first abutment (10) securing the adjusting mechanism (3) on the camshaft (1) and tightly sealing the hydraulic channel arranged coaxially within the inside shaft (4) at one end axially.

9. The camshaft according to claim 1, wherein the first and/or the second bearing ring(s) (11, 14) is/are shrunk onto the outside shaft (2).

* * * * *

UNITED STATES PATENT AND TRADEMARK OFFICE

CERTIFICATE OF CORRECTION

PATENT NO. : 7,503,293 B2
APPLICATION NO. : 11/820257
DATED : March 17, 2009
INVENTOR(S) : Lettmann et al.

It is certified that error appears in the above-identified patent and that said Letters Patent is hereby corrected as shown below:

Column 4, line 59, Claim 1 after the word "produce", please change "this" to correctly read: --a--.

Signed and Sealed this

Eighteenth Day of August, 2009

David J. Kappos

David J. Kappos
*Director of the United States Patent and Trademark Office*